US008646598B2

(12) United States Patent
Idheileh

(10) Patent No.: US 8,646,598 B2
(45) Date of Patent: Feb. 11, 2014

(54) INDIVIDUALLY WRAPPED ROLLING PAPERS

(71) Applicant: Amer M. Idheileh, Christiansted, VI (US)

(72) Inventor: Amer M. Idheileh, Christiansted, VI (US)

( * ) Notice: Subject to any disclaimer, the term of this patent is extended or adjusted under 35 U.S.C. 154(b) by 0 days.

(21) Appl. No.: 13/755,302

(22) Filed: Jan. 31, 2013

(65) Prior Publication Data

US 2013/0313146 A1 Nov. 28, 2013

Related U.S. Application Data

(60) Provisional application No. 61/650,814, filed on May 23, 2012.

(51) Int. Cl.
*B65D 69/00* (2006.01)

(52) U.S. Cl.
USPC ..... 206/237; 206/449

(58) Field of Classification Search
USPC ..... 206/38, 236, 237, 49, 484, 39, 39.7, 206/242, 260, 271
See application file for complete search history.

(56) References Cited

U.S. PATENT DOCUMENTS

| | | | | |
|---|---|---|---|---|
| 3,278,109 | A * | 10/1966 | Salway | 206/484 |
| 6,321,755 | B1 | 11/2001 | Sinclair, Jr. | |
| 6,357,448 | B1 | 3/2002 | Sinclair, Jr. | |
| 6,526,986 | B1 | 3/2003 | Sinclair, Jr. | |
| 6,724,525 | B2 | 4/2004 | Okuno et al. | |
| 6,854,471 | B1 | 2/2005 | Sinclair, Jr. | |
| 7,282,249 | B2 | 10/2007 | Harrison et al. | |
| 8,393,332 | B2 * | 3/2013 | Kesselman | 131/329 |
| 2005/0072439 | A1 * | 4/2005 | Darwish | 131/347 |
| 2008/0308431 | A1 * | 12/2008 | Kesselmann et al. | 206/237 |
| 2009/0014342 | A1 * | 1/2009 | Kesselman et al. | 206/237 |
| 2009/0020443 | A1 * | 1/2009 | Kesselman | 206/237 |
| 2009/0127148 | A1 * | 5/2009 | Pratis Palazzo | 206/494 |
| 2010/0206757 | A1 * | 8/2010 | Kesselman | 206/494 |

* cited by examiner

*Primary Examiner* — Jacob K Ackun
(74) *Attorney, Agent, or Firm* — Gold & Rizvi, P.A.; Glenn E. Gold

(57) ABSTRACT

A rolling paper and packaging combination that individually seals each rolling paper substrate within its own individual, moisture resistant compartment. The moisture resistant compartments are fabricated by bonding a first wrapper and a second wrapper along each longitudinal edge and each transverse edge. The wrappers are fabricated of a moisture impervious material. A series of rolling paper substrates can be spatially arranged along a length of the wrappers, wherein the wrappers would be transversely bonded between adjacent edges of adjacently located substrates. The intermediary bonds can be perforated to aid in separation of one compartment from the series of compartments. The individual packaging extends the useful life of packaged rolling papers, particularly for rolling papers fabricated of moisture sensitive materials such as homogenized paper, and the like.

16 Claims, 10 Drawing Sheets

INDIVIDUALLY WRAPPED ROLLING PAPERS

CROSS-REFERENCE TO RELATED APPLICATION

This U.S. non-provisional patent application claims the benefit of co-pending U.S. provisional patent application Ser. No. 61/650,814, filed on May 23, 2012 by the same inventor, which is incorporated herein in its entirety.

FIELD OF THE INVENTION

The present disclosure generally relates to the packaging of tobacco rolling substrates and, more particularly, to such a packaging construction wherein individual sheets of homogenized rolling substrate are provided individually packaged.

BACKGROUND OF THE INVENTION

Substrates for rolling tobacco products and herbs are well known. Such substrates can be natural or manufactured. For example, it is known to use a raw tobacco leaf to roll your own cigar. Likewise, it is known to use manufactured tobacco rolling substrates for the same purpose. Smokers often use a variety of lingo to refer to tobacco rolling substrates, including "rolling paper," "cigarette paper," "cigar wraps," "wraps" and the like. Generally speaking, these substrates are small sheets, rolls, or leaves of paper substrate that are packaged and sold for rolling smokable product into a cigarette form. Typically, the rolling process is accomplished either by hand or with the aid of a rolling apparatus. During the process of rolling a cigarette, an individual sheet of rolling paper may be filled with tobacco, herbs, cannabis, hash, cloves, damiana leaves, and other smokable product.

Rolling paper is offered for those people who prefer to roll their own cigarette or cigar, where the person can customize the cigarette or cigar using any blend of smokable product rolled into any shape and size they prefer.

Rolling papers are most commonly fabricated from wood pulp, hemp, flax, rice straw, tobacco, and the like. The common form factor of a single rolling paper is a long rectangle having a narrow strip of glue, gum or other adhesive all along one of the long edges. Depending upon the geographic region, rolling paper may or may not have gummed edges. Rolling papers made from tobacco usually do not have gummed edges; however, gummed edges can easily be added if required. Rolling paper constructed from tobacco is usually referred to as "homogenized paper," "cigar wraps," or simply "wraps."

Rolling papers are usually sold in lengths falling within a range of 70 mm to 110 mm, and various widths. Most manufacturers sell rolling paper using the designations of "1 (Single wide)," "1¼ sized," "1½ sized" and "Doublewide (2 or 2.0)." However, within the industry, these designations have slightly different meanings, wherein the size references are not definitive but moreover a general size. Across the various brands of cigarette papers the actual widths of the papers using these designations vary greatly. For example, the 1¼ designation is used with papers having widths ranging from about 1.7 inches to 2 inches, and the 1½ designation is used with papers having widths ranging from around 2.4 to 3 inches. However the length of these papers is always 78 mm (+/−1 mm). It is noted that the 1¼ size is also referred to as "Spanish Size" or "French" rolling paper in some parts of the world.

While a 1¼ sized paper is not exactly 25% larger than a 1 (single wide) paper, there is meaning to these size names. A better way to describe these accurately is that a 1¼ size is designed to roll a cigarette that contains about 25% more filler than a single wide paper. Similarly a 1½ sized paper is designed to roll a cigarette that contains about 50% more than a single wide paper. A 1¼ sized paper is larger than a 1 (single wide) paper and naturally a 1½ sized size paper is larger than a 1¼ sized paper, and a double wide is larger than a 1½ sized paper.

King Size is another multi-meaning term. While a King Size cigarette is typically 84 mm long, a King Size rolling paper has a length of 100 mm or 110 mm.

Rolling paper is commonly packaged in a configuration stacking a plurality of individual sheets and placing the stack within a dispensing box. Rolling paper is extremely sensitive to moisture. The current packaging configuration leaves the rolling paper susceptible to damage from moisture absorption. It is understood that the longer period of time the rolling paper is stored, the greater the likelihood of absorption of moisture, resulting in damaged and unusable product.

Such damage may be exacerbated in a packaging configuration where the rolling papers are bound in a booklet formation, exposing the rolling papers to humidity in the environment.

What is desired is a packaging that isolates the rolling paper from exposure to moisture, thus extending the shelf life of the packaged rolling paper. Furthermore, it would be highly desirable to provide individually packaged leaves of rolling substrate, wherein the individual packages are hermetically sealed in order to extend the useful shelf life of the product—particularly for rolling papers fabricated of homogenized paper or other moisture sensitive materials.

SUMMARY OF THE INVENTION

The basic inventive concept packages each sheet of rolling paper within an individual moisture barrier.

A first aspect of the present invention provides a rolling paper packaging configuration comprising:

a plurality of individual sheets of rolling paper, wherein the rolling paper substrate is characterized for use in rolling a smokeable product into a form of a cigarette;

a first wrapper fabricated of a moisture impervious material bound by a first elongated edge and a second elongated edge, wherein the first elongated edge and the second elongated edge are parallel to one another;

a second wrapper fabricated of a moisture impervious material bound by a first elongated edge and a second elongated edge, wherein the first elongated edge and the second elongated edge are parallel to one another;

the plurality of individual sheets of rolling paper are spatially arranged between the first wrapper and the second wrapper; and the first elongated edge of the first wrapper and the first elongated edge of the second wrapper are hermetically sealed to one another;

the second elongated edge of the first wrapper and the second elongated edge of the second wrapper are hermetically sealed to one another;

the first wrapper and the second wrapper are hermetically sealed to one another along a transverse direction at each end thereof; and the first wrapper and the second wrapper are hermetically sealed to one another along a transverse direction between each pair of adjacently positioned rolling papers forming individual compartments for each individual rolling paper.

A second aspect of the present invention incorporates a perforation along each transverse seal formed between each rolling paper substrate.

In another aspect the rolling paper substrate is fabricated of paper, homogenized paper, homogenized tobacco-impregnated paper, homogenized tobacco, wood pulp, hemp, flax, rice straw, a tobacco leaf, esparto (in rare instances), and the like.

In yet another aspect, at least one of the first wrapper and the second wrapper is fabricated of one of a translucent and transparent material.

In yet another aspect, each of the individual compartments is sealed under a vacuum and void of moisture and air.

In yet another aspect, the rolling paper further comprises a moisture activated gum applied in a form of a strip adjacent to one longitudinal edge of one surface of each rolling paper substrate.

In yet another aspect, a smokeable product is placed upon the rolling paper and the rolling paper is rolled into a form of a cigarette.

In another aspect, a contiguous series of individually packaged rolling papers may be mounted upon a rod to facilitate removal of a user-specified segment thereof.

In another aspect, a relatively small contiguous series of individually packaged rolling papers can be carried within a portable pouch having a sealable opening along one side to facilitate removal of a user-selected quantity of packaged papers.

In another aspect, a relatively small contiguous series of individually packaged rolling papers can be carried within a portable tube having removable end to facilitate easy insertion of the series of packaged rolling papers into the tube, and a slot provide through the tube housing to facilitate removal of a user-selected quantity of packaged papers.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
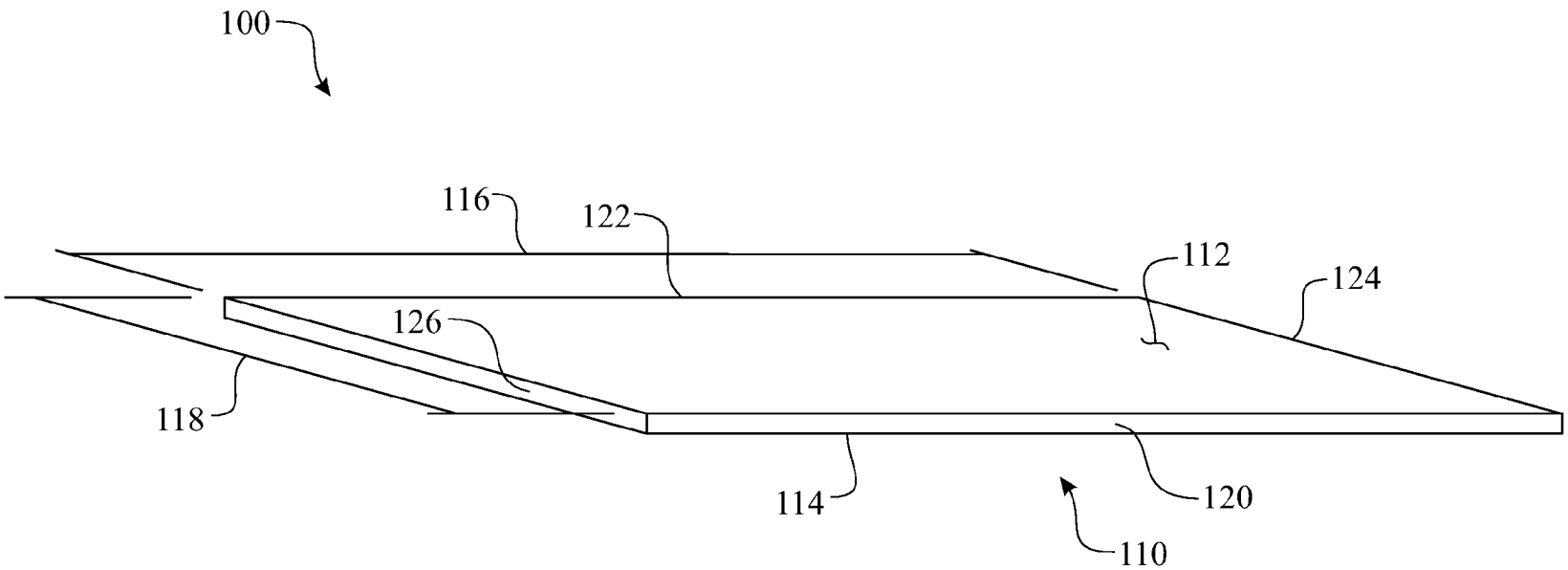
FIG. 1 presents an isometric view of an exemplary rolling paper substrate.
Figure 2:
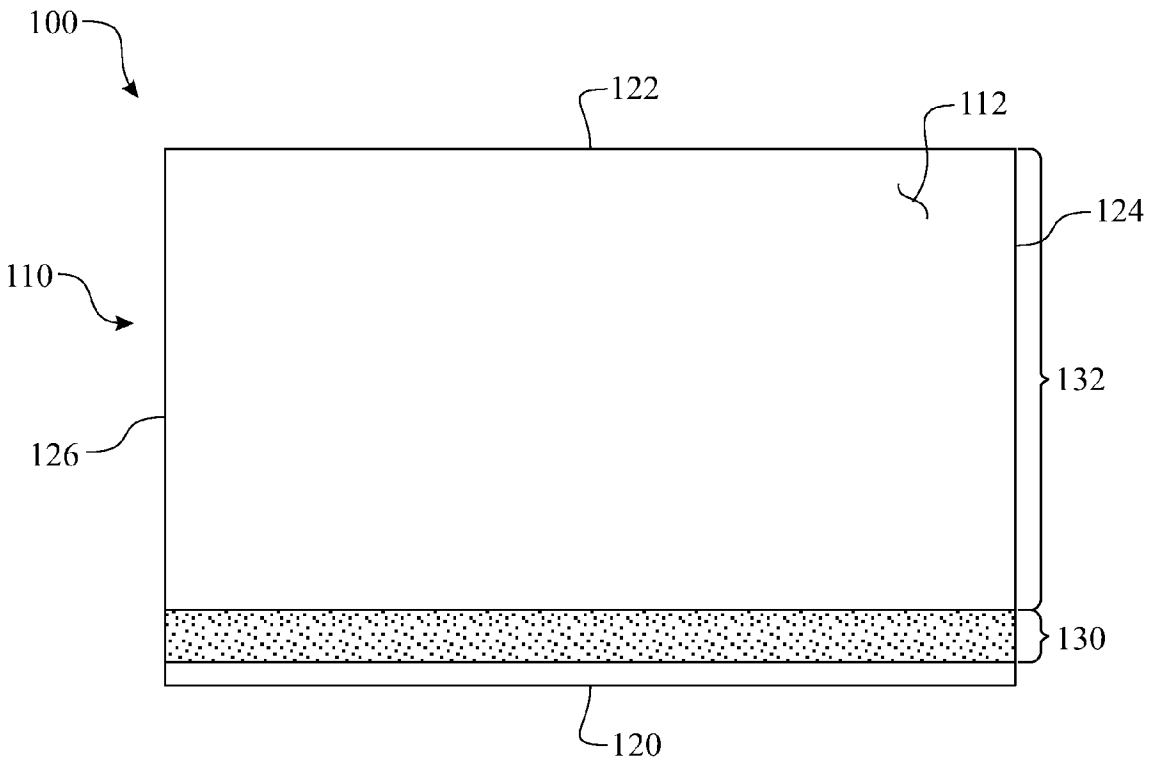
FIG. 2 presents a top plan view of the rolling paper substrate originally introduced in FIG. 1.
Figure 3:
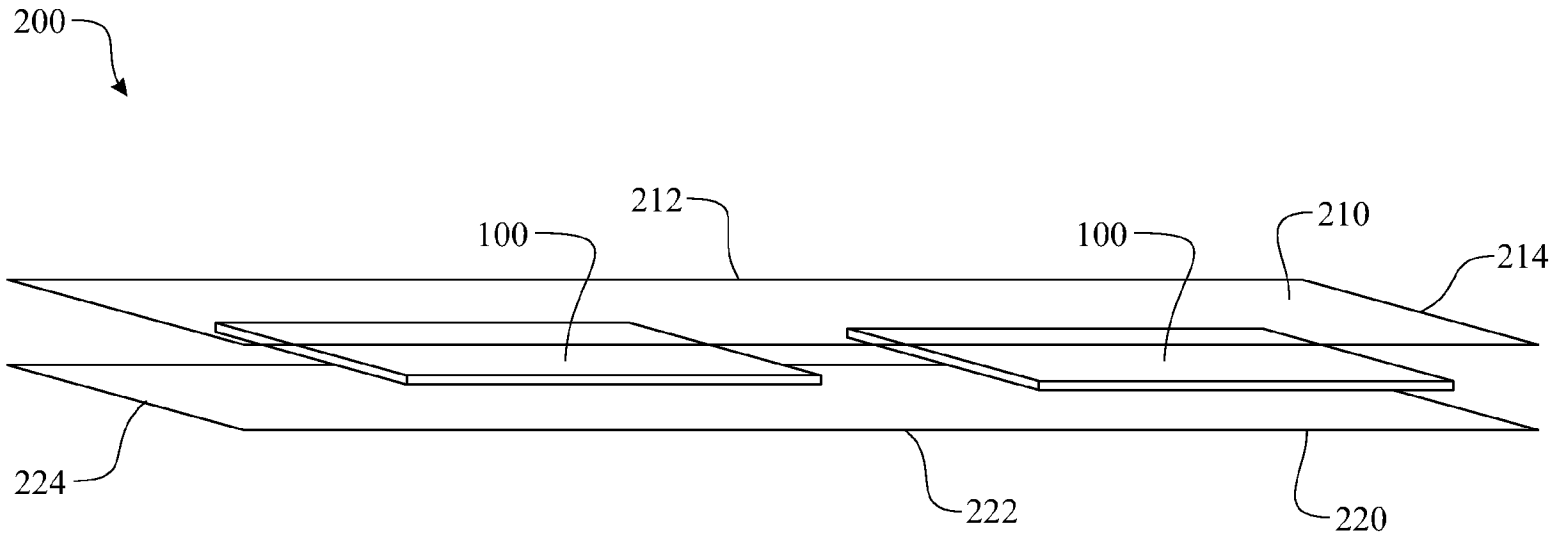
FIG. 3 presents an exploded isometric view of an exemplary individual rolling paper packaging configuration shown in a pre-sealed configuration.

An exemplary individual tobacco rolling substrate or paper 100 is illustrated in FIGS. 1 and 2. The rolling paper 100 includes a moisture activated gum strip 130 applied to at least one surface of a common rolling paper substrate 110. The rolling paper substrate 110 is fabricated of a paper, homogenized paper, homogenized tobacco-impregnated paper, homogenized tobacco, wood pulp, hemp, flax, rice straw, a tobacco leaf, esparto (in rare instances), and the like. The application described herein is particularly directed towards a tobacco rolling substrate 110 that is fabricated of a homogenized paper. The homogenized substrate 110 can be defined as a planar sheet of flexible, combustible material having a smokable substance-receiving surface 112 located on a first side and an exterior rolled surface 114 located on a second, opposite side; the surfaces bound by a continuous peripheral edge defined by a first longitudinal rolling paper edge 120, a second longitudinal rolling paper edge 122, a first lateral rolling paper edge 124 and a second lateral rolling paper edge 126. The two longitudinal rolling paper edges 120, 122 define a longitudinal dimension 116 of the rolling paper substrate 110 and are preferably parallel to one another. The two transverse rolling paper edges 124, 126 define a transverse dimension 118 of the rolling paper substrate 110 and are also preferably parallel to one another. The two longitudinal rolling paper edges 120, 122 are preferably perpendicular to the two transverse rolling paper edges 124, 126.

In the exemplary embodiment, a moisture activated gum strip 130 is disposed upon a portion of the smokeable substance receiving surface 112. In the embodiment presented in FIGS. 1 and 2, the moisture activated gum strip 130 covers a strip of the smokeable substance receiving surface 112 adjacent to the first longitudinal rolling paper edge 120. The moisture activated gum strip 130 is well known in the industry. The moisture activated gum strip 130 can be flavor-free and/or scent-free to minimize any adverse effects of the gum composition on the smoking experience. Alternatively, the moisture activated gum strip 130 can be enhanced by adding a flavoring and/or scent thereto to enhance the smoking experience.

The rolling paper substrate 110 is sized to meet the common, standard rolling paper dimensions. The exemplary rolling paper substrate 110 is dimensionally referenced by the longitudinal dimension 116 (length) and transverse dimension 118 (width). The common form factor of a single rolling paper is a long rectangle having a narrow strip of glue or gum (moisture activated gum strip 130) along one of the long edges. Rolling papers are offered in standard lengths between 70 mm through 110 mm and a range of widths. The width of the rolling papers is commonly referenced using the designations of 1 (Single wide), 1¼ size, 1½ size and "Doublewide" (2 or 2.0). The 1¼ designation generally refers to papers having widths ranging from about 1.7 inches to 2 inches. The 1½ designation generally refers to papers having widths ranging from around 2.4 to 3 inches. The typical length of rolling papers is 78 mm, with a tolerance of +/−1 mm.

It is noted that the rolling paper substrate 110 may be flavored to enhance the smoking experience.

Figure 7:
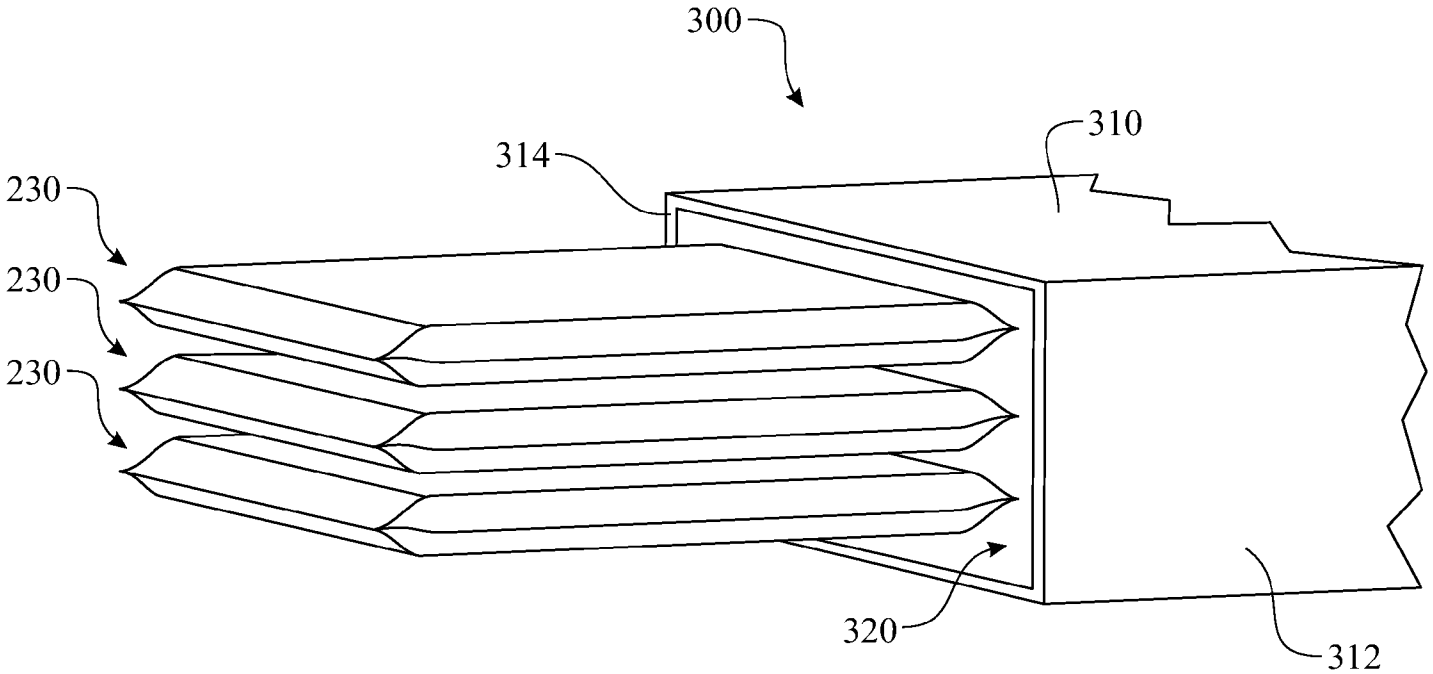
FIG. 7 presents an isometric view of a plurality of individually wrapped rolling paper substrates being inserted into a rolling paper carton.

Each rolling paper 100 is individually packaged, as illustrated in FIGS. 3-6, with an alternative packaging being illustrated in FIG. 7. The packaging bonds a first wrapper 210 and a second wrapper 220 together in a manner forming an individually-packaged series of rolling papers 200 comprising a series of individual rolling paper packages 230, which are moisture-resistant containers for carrying each rolling paper 100 individually. A plurality of rolling papers 100 are equally spaced along a second wrapper 220. A first wrapper 210 is placed covering the distributed rolling papers 100. The first and second wrappers, 210 and 220 respectively, are bonded together along each mating elongated edge 212, 222 forming longitudinal sealed edges 232, 234. The first wrapper 210 and second wrapper 220 are preferably fabricated of a moisture impervious material. The first wrapper 210 and second wrapper 220 are bonded together along each mating transverse edge 214, 224 forming transverse sealed edges 236, 238. The first wrapper 210 and second wrapper 220 are bonded together between adjacently positioned pairs of rolling papers 100 forming a perforated sealed edge 239. The two bonded elongated edges 232, 234 in combination with any pair of adjacent bonded transverse edges 236, 238, 239 define each sealed packaging interior 240. Each perforated sealed edge 239 is preferably comprises a perforation, scoring, and the like to assist the user in separating a formed sealed packaging interior 240 from an adjacent formed sealed packaging interior 240. Each of the bonded edges provides hermetical seals creating a moisture barrier between the environment and each individually wrapped rolling paper 100. Any known seal forming process can be employed to create the desired sealed bonds between the first wrapper 210 and the second wrapper 220. The wrappers 210, 220 can be fabricated of any suitable, moisture impervious material. At least one of the wrappers 210, 220 can be fabricated of a translucent of transparent material. At least one of the wrappers 210, 220 can be fabricated of a metallic material, a foil material, a plastic material, a Mylar material, an aluminum material, and the like.

The bonding process can be accomplished using any suitable process respective to the material selected for the wrappers 210, 220. This can include thermal bonding, ultrasonic bonding, application of an adhesive or other bonding agent, and the like.

The bonding process can additionally include a vacuum process to remove air and moisture from the sealed packaging interior 240, wherein each sealed packaging interior 240 is sealed under a vacuum and void of moisture and air. Removal of air and moisture from the sealed packaging interior 240 can enhance the shelf life of the rolling paper 100.

The individually packaged series of rolling papers 200 can be arranged in any of a variety of configurations for distribution and sales. One optional configuration would be an accordion configuration, where each of the series of individual rolling paper packages 230 would be folded upon each adjacent individual rolling paper package 230 for distribution. A second optional configuration would be a rolled configuration, where the series of individual rolling paper packages 230 would be rolled for distribution. The entire series of individual rolling paper packages 230 can be sold as a single item or a desired quantity of individual rolling paper packages 230 can be separated from the series of individual rolling paper packages 230 and sold per individual package.

It is understood that the packaging can be accomplished using a single wrapper 210, 220 folding along a longitudinal axis, replicating the effect of two wrappers 210, 220.

Figure 4:
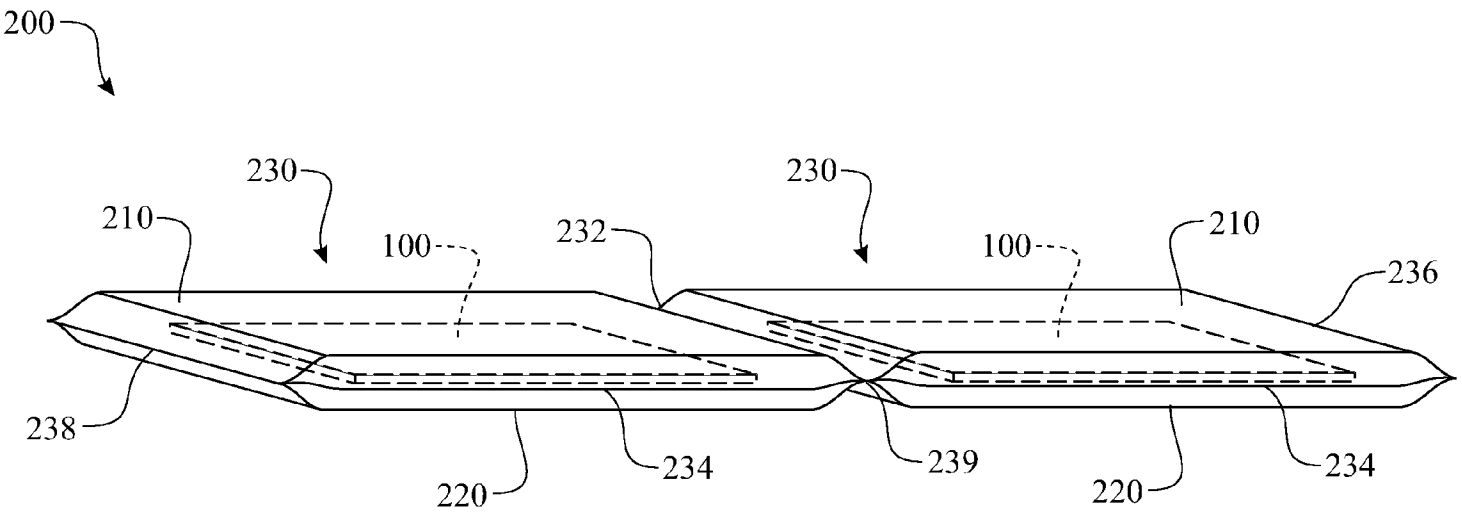
FIG. 4 presents an isometric view of the individual rolling paper packaging configuration shown in a sealed configuration.
Figure 5:
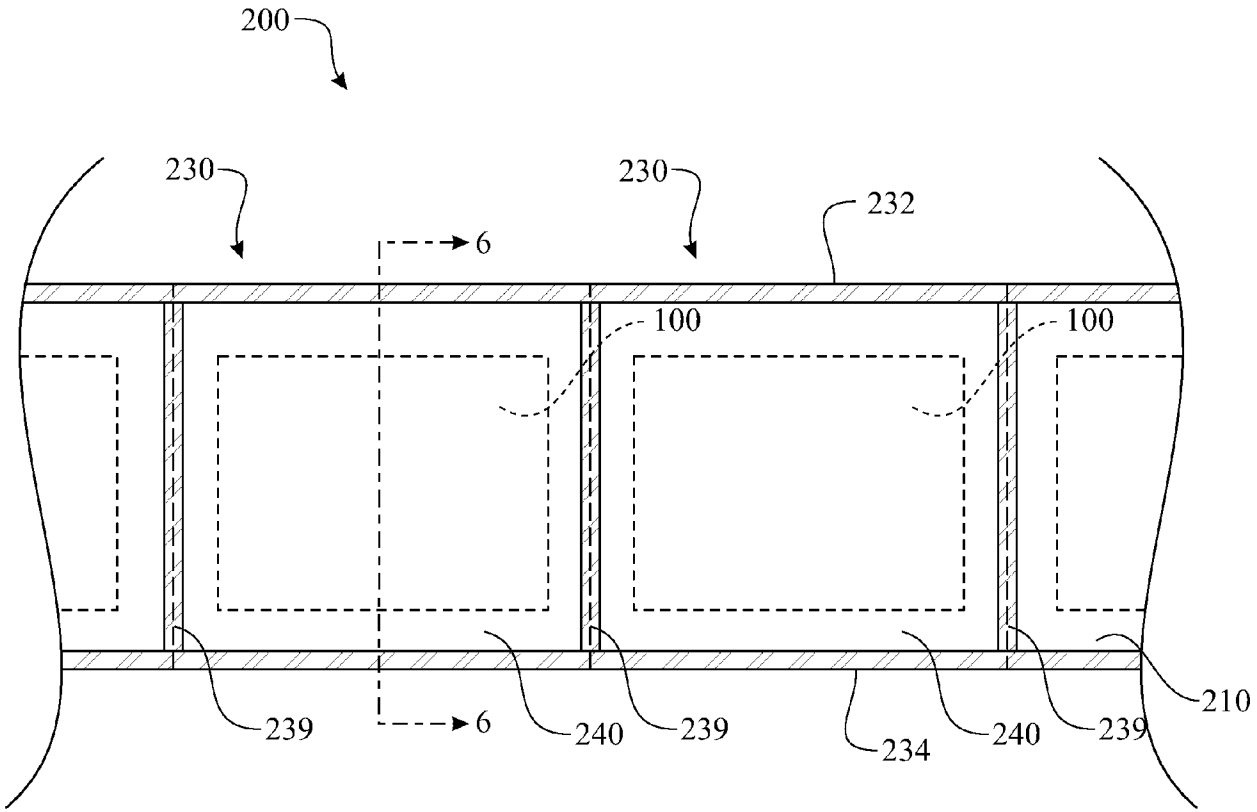
FIG. 5 presents a top plan view of the individual rolling paper packaging configuration of FIG. 4.
Figure 6:
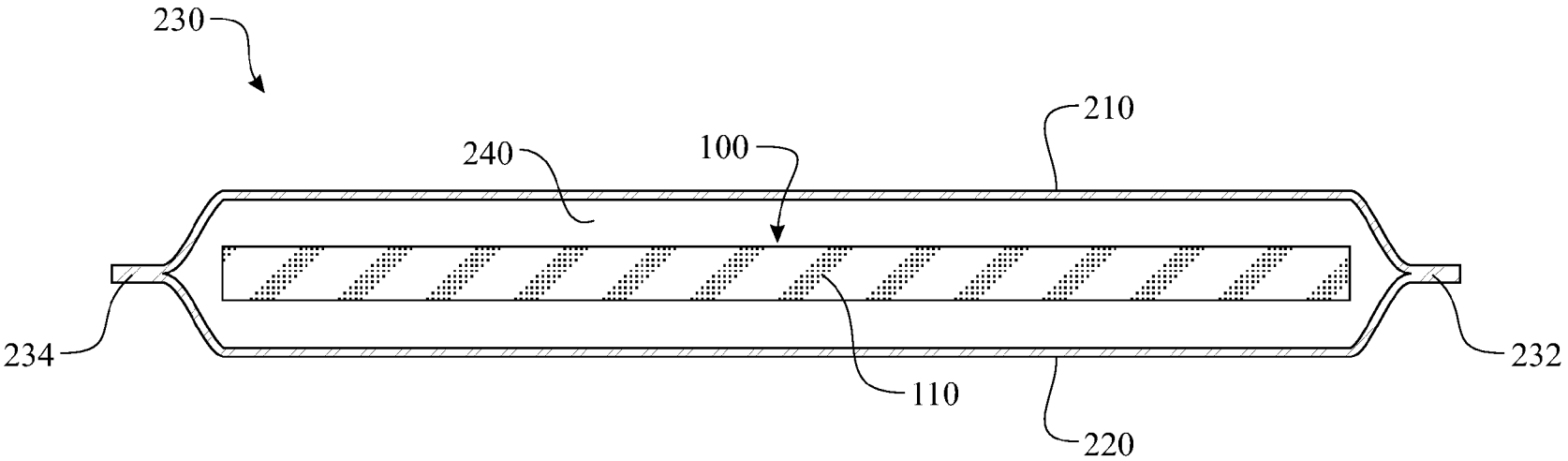
FIG. 6 presents a sectioned elevation view of the individual rolling paper packaging configuration, the section being taken along section line 6-6 of FIG. 5.

The individual rolling paper package 230 can be packaged in a continuous linear series as presented in FIGS. 4 and 5 or singulated and packaged as presented in FIG. 7. A plurality of individual rolling paper packages 230 can be stacked and inserted into a rolling paper carton 300. The rolling paper carton 300 can be fabricated in any form factor. The exemplary rolling paper carton 300 includes a pair of horizontal carton walls 310 and a pair of vertical carton walls 312 forming a rectangular shaped package. The rectangular shaped package defines a carton interior volume 320 for receiving and storing goods; in the exemplary embodiment, a plurality of individual rolling paper packages 230. The rectangular shaped package includes a carton opening 314 providing a passageway for insertion of a plurality of individual rolling paper packages 230 into the carton interior volume 320. It is understood that the rolling paper carton 300 can include a closure (not shown) for retaining the plurality of individual rolling paper packages 230 therein.

Figure 8:
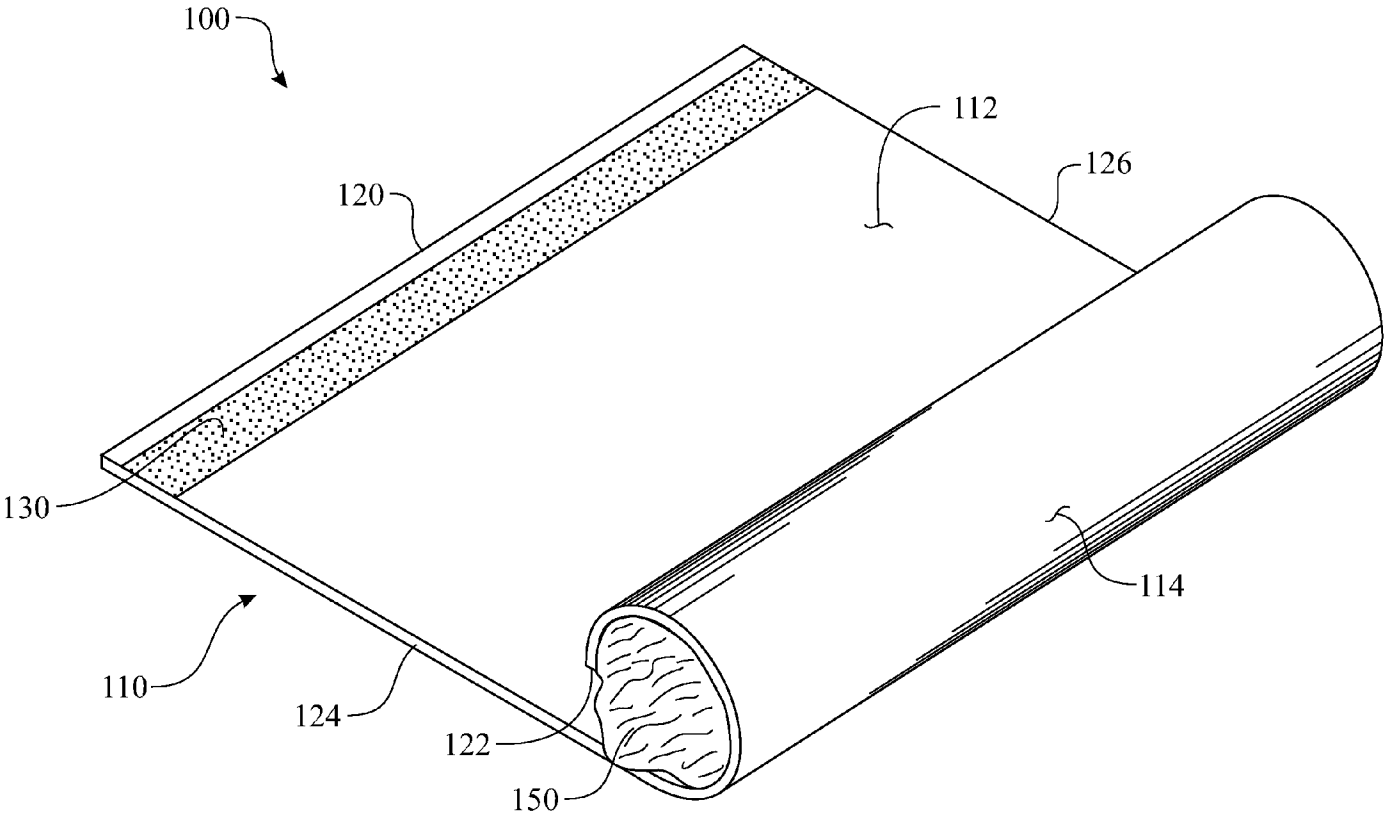
FIG. 8 presents an isometric view illustrating a typical cigarette or cigar rolling process using the rolling paper substrate originally introduced in FIG. 1

An exemplary process of rolling a smokeable product 150 within the rolling paper 100 is illustrated in FIG. 8. The smokeable product 150 can be any smokeable product, including tobacco, cannabis (where legally consumable), hash, cloves, damiana, and any other legally consumable smokeable product in the respective region. The process initiates by preferably placing the rolling paper 100 upon a horizontal surface, orienting the smokeable substance receiving surface 112 facing upward. A volume of smokeable product 150 is placed spanning across the smokeable substance receiving surface 112 in a transverse direction adjacent to the second longitudinal rolling paper edge 122. Once the smokeable product 150 is disbursed across the smokeable substance receiving surface 112, the rolling paper substrate 110 is rolled, entrapping the volume of smokeable product 150 therein. At some point in the process moisture is applied to the moisture activated gum strip 130, activating the bonding agent. The rolling process continues until the moisture activated gum strip 130 bonds with the roll. Once complete, the rolled cigarette awaits ignition and inhalation. When desired, the user would ignite a distal end of the rolled cigarette and subsequently inhale fumes from the burning rolled cigarette. The user would periodically inhale the fumes emanating from the burning rolled cigarette until the cigarette is significantly depleted.

Figure 9:
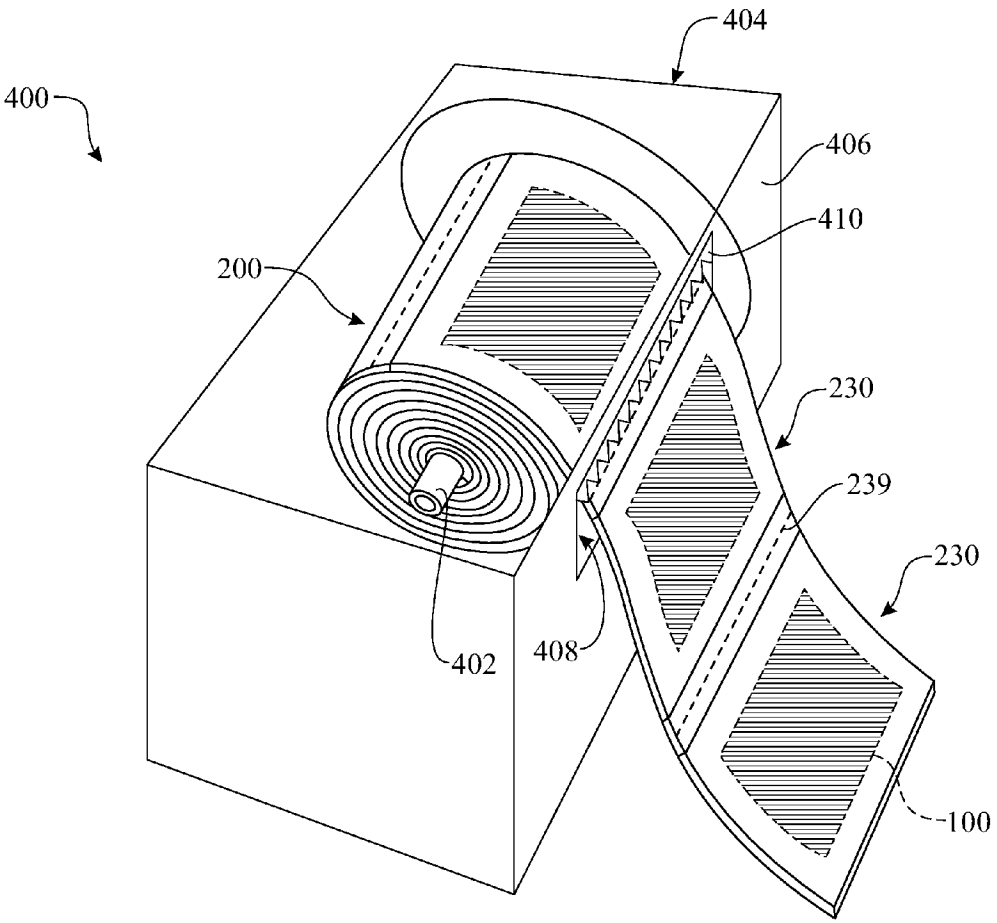
FIG. 9 presents a roll of a series of individually wrapped rolling paper substrates mounted for dispensing one or more packaged substrates.

Referring now particularly to FIG. 9, and shown generally as reference numeral 400, in an optional implementation of the present invention, the product can be provided in a rolled-up configuration 200 of a contiguous length of the individual packages 230, each package containing a rolling paper substrate 100. The roll 200 of contiguous individual packages can be mounted upon a rod 402 for easy dispensing of a user-selected quantity of the contiguous individual packages. Optionally, the rod 402 may be mounted to the interior of a dispenser housing 404. The housing 404 may have an opening 408 provided extending through a housing side 406. Optionally, the housing may have a serrated edge 410 tearing off the user-selected segment from the roll 200. Alternatively, the user can tear off a selected segment of packages along perforations 239 separating adjacent packages 230. This dispensing configuration would be beneficial for use selling the product of the present invention, for example, at the check-out area of a brick-and-mortar merchant location.

Figure 10:
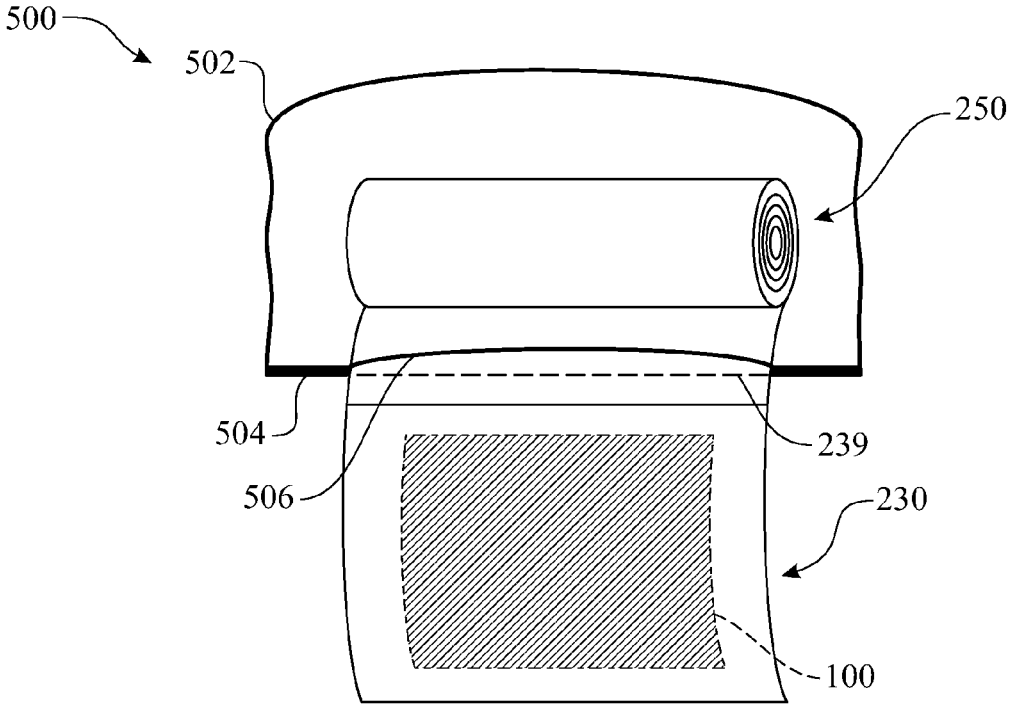
FIG. 10 presents a user-sized quantity of packaged substrate in the form of a roll carried in a portable pouch by the user, wherein the user can remove one or more packaged papers through a zip lock type opening in the pouch.

Referring now particularly to FIG. 10, and shown generally as reference numeral 500, in an optional implementation of the present invention, a relatively shorter length, or segment, of a contiguous series of packages 230, each containing an individual rolling paper 100, may be provided in a smaller-sized rolled-up configuration 250 carried upon one's person in a flexible pouch 502. Preferably, the pouch 502 has a releasably sealable longitudinal edge 504 that, when unsealed, creates an opening 506 through which a person carrying the pouch can selectively dispense and tear off one or more packages 230 each containing a sheet of rolling substrate 100.

Figure 11:
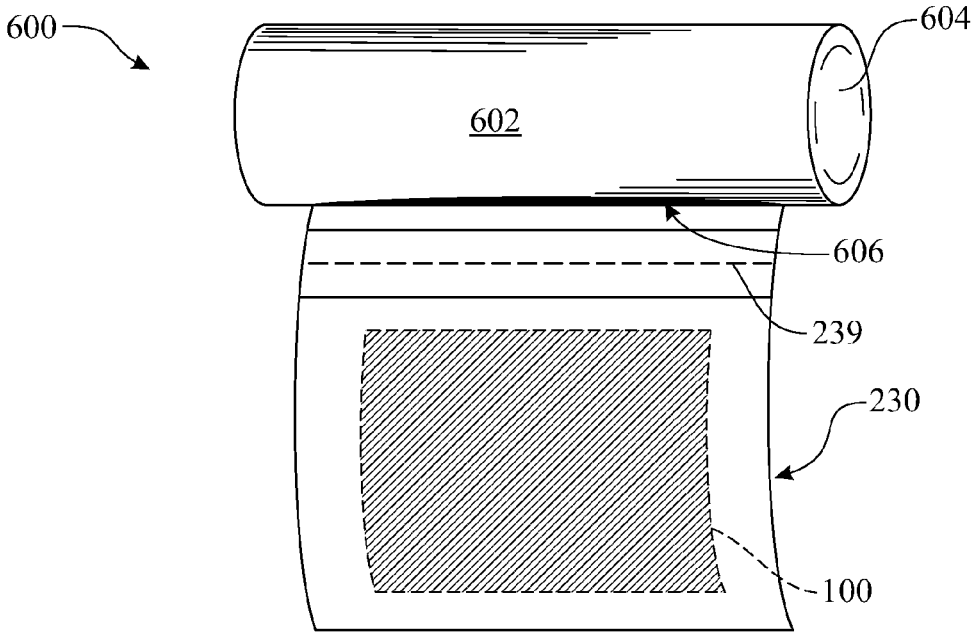
FIG. 11 presents a portable cylindrical tube for carrying a user-sized quantity of packaged substrate in the form of a roll, which enables the user to dispense a desired quantity of packaged papers through a slot-type opening provided longitudinally through the tube.

Referring now particularly to FIG. 11, and as shown generally as reference numeral 600, in an optional implementation of the present invention, a relatively shorter length, or segment, of a contiguous series of packages 230, each containing an individual rolling paper 100, may be provided in a smaller-sized rolled-up configuration (such as shown as 250 in FIG. 10) carried upon one's person in a cylindrical tube 602. Preferably, the tube 602 has a removable end cap 604, or similar closure that, when unsealed, creates an opening for inserting the roll 250 therein. Preferably, a longitudinal opening or slot 606 extending through tube wall is provided to enable a person carrying the tube to selectively dispense and tear off one or more packages 230 each containing a sheet of rolling substrate 100.

The individually wrapped rolling paper packages 230 provide significant advantages over conventional packaging. One such advantage is that the individual substrate sheets 100 are fabricated of a homogenized paper. Another advantage is the increase of useable product life between packaging and use (i.e., shelf life). The user can open one individual rolling paper package 230 without exposing the balance of the rolling papers 100 to moisture. The packaging enables a variety of sales or distribution options, where the individual rolling paper package 230 can be sold individually, at a quantity requested by the consumer, in predetermined quantities, and the like. The individual rolling paper packages 230 can be sold singulated or in a continuous series of packages. Another advantage is that the packaging construction, which lends itself to the easy formation of rolled up series of packages, can be easily carried by an individual, in a pouch, tube or other portable dispensing structure for ease of use.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A rolling paper and packaging configuration combination comprising:

a plurality of individual sheets of rolling paper substrates, wherein said rolling paper substrate is characterized for use in rolling a smokeable product into a form of a cigarette or cigar;

a first wrapper fabricated of a moisture impervious material bound by a first elongated edge and a second elongated edge, wherein said first elongated edge and said second elongated edge are parallel to one another;

a second wrapper fabricated of a moisture impervious material bound by a first elongated edge and a second elongated edge, wherein said first elongated edge and said second elongated edge are parallel to one another;

said plurality of individual sheets of rolling paper are spatially arranged between said first wrapper and said second wrapper; and said first elongated edge of said first wrapper and said first elongated edge of said second wrapper are hermetically sealed to one another;

said second elongated edge of said first wrapper and said second elongated edge of said second wrapper are hermetically sealed to one another;

said first wrapper and said second wrapper are hermetically sealed to one another along a transverse direction at each end thereof; and said first wrapper and said second wrapper are hermetically sealed to one another along a transverse direction between each pair of adjacently positioned rolling papers forming individual compartments for each individual rolling paper substrate.

2. A rolling paper and packaging configuration combination as recited in claim 1, said hermetical seal between each pair of adjacently positioned rolling papers further comprises a perforation to aid in separating one individual compartment from said series of individual compartments.

3. A rolling paper and packaging configuration combination as recited in claim 1, wherein each of said series of individual compartments are sealed under a vacuum and void of moisture and air.

4. A rolling paper and packaging configuration combination as recited in claim 1, wherein at least one of said first wrapper and said second wrapper is fabricated of one of a translucent and transparent material.

5. A rolling paper and packaging configuration combination as recited in claim 1, wherein said bonded edges are at least one of: thermally bonded edges, ultrasonically bonded edges, and adhesively bonded edges.

6. A rolling paper and packaging configuration combination as recited in claim 1, wherein at least one of said first wrapper and said second wrapper is fabricated of at least one of:

a metallic material; a foil material; a plastic material; a Mylar material, and an aluminum material.

7. A rolling paper and packaging configuration combination as recited in claim 1, wherein said rolling paper substrate is fabricated from one of:

paper; homogenized paper; homogenized tobacco-impregnated paper; homogenized tobacco; wood pulp; hemp; flax; rice straw; and a tobacco leaf.

8. A rolling paper and packaging configuration combination as recited in claim 1, the series of individual compartments are arranged in one of the following configurations:

a rolled configuration, and an accordion configuration.

9. A rolling paper and packaging configuration combination comprising:

an individual sheet of a rolling paper substrate, wherein said rolling paper substrate is characterized for use in rolling a smokeable product into a form of a cigarette or cigar;

a first wrapper fabricated of a moisture impervious material bound by a first elongated edge and a second elongated edge, wherein said first elongated edge and said second elongated edge are parallel to one another;

a second wrapper fabricated of a moisture impervious material bound by a first elongated edge and a second elongated edge, wherein said first elongated edge and said second elongated edge are parallel to one another;

said individual sheet of rolling paper is positioned between said first wrapper and said second wrapper; and said first elongated edge of said first wrapper and said first elongated edge of said second wrapper are hermetically sealed to one another;

said second elongated edge of said first wrapper and said second elongated edge of said second wrapper are hermetically sealed to one another; and said first wrapper and said second wrapper are hermetically sealed to one another along a transverse direction at each end thereof sealing said sheet of rolling paper substrate within a resulting individual compartment.

10. A rolling paper and packaging configuration combination as recited in claim 1, wherein said individual compartment is sealed under a vacuum and void of moisture and air.

11. A rolling paper and packaging configuration combination as recited in claim 10, wherein at least one of said first wrapper and said second wrapper is fabricated of one of a translucent and transparent material.

12. A rolling paper and packaging configuration combination as recited in claim 10, further comprising:

a plurality of sheets of rolling paper, each sheet of rolling paper packaged in a respective individual compartment formed by a respective first wrapper and second wrapper; and a rolling paper carton comprising a plurality of sides forming a carton interior volume, wherein said plurality of individually packaged sheets of rolling paper are inserted within said carton interior volume.

13. A rolling paper and packaging configuration combination as recited in claim 10, wherein said bonded edges are at least one of: thermally bonded edges; ultrasonically bonded edges; and adhesively bonded edges.

14. A rolling paper and packaging configuration combination as recited in claim 10, wherein at least one of said first wrapper and said second wrapper is fabricated of at least one of:

a metallic material; a foil material; a plastic material, a Mylar material, and an aluminum material.

15. A rolling paper and packaging configuration combination as recited in claim 10, said rolling paper substrate is fabricated of one of:

Paper; homogenized paper, homogenized tobacco-impregnated paper; homogenized tobacco; wood pulp; hemp; flax; rice straw; and a tobacco leaf.

16. A rolling paper and packaging configuration combination as recited in claim 10, said rolling paper substrate further comprising an adhesive strip adjacent to a longitudinal edge of at least one surface of said rolling paper substrate.

* * * * *